United States Patent [19]

McCaffery

[11] Patent Number: 4,749,366

[45] Date of Patent: Jun. 7, 1988

[54] HEAVY CURRENT ELECTRICAL TERMINATION MEANS

[75] Inventor: Derek W. McCaffery, Potters Bar, England

[73] Assignee: AMP Incorporated, Harrisburg, Pa.

[21] Appl. No.: 78,931

[22] PCT Filed: Apr. 14, 1986

[86] PCT No.: PCT/US86/00787

§ 371 Date: Dec. 10, 1986

§ 102(e) Date: Dec. 10, 1986

[87] PCT Pub. No.: WO86/07200

PCT Pub. Date: Dec. 4, 1986

[30] Foreign Application Priority Data

May 22, 1985 [GB] United Kingdom ..... 8512965

[51] Int. Cl.[4] ..... H01R 4/24

[52] U.S. Cl. ..... 439/396

[58] Field of Search ..... 439/391, 395, 396, 402, 439/404, 417, 425

[56] References Cited

U.S. PATENT DOCUMENTS 4,018,499 4/1977 Rickards ..... 439/396

4,527,852 7/1985 Dechelette ..... 439/396

*Primary Examiner*—Joseph H. McGlynn

*Attorney, Agent, or Firm*—Thomas G. Terrell

[57] ABSTRACT

A heavy current electrical terminal (2) comprises a flat metal plate (4) having a wire slot (6) with a flared, insulation piercing, mouth (8) opening into an edge of the plate (4). An insulation piercing and wire support anvil (12) projects from base of the slot (6) which has an elongate constricted portion (18) between the mouth (8) and the anvil (12). The anvil (12) serves to support and to locate a heavy current wire (32) having insulation (34), when the wire (32) has been forced down into the portion (18) of the slot (6). The terminal (2) may be arranged in a housing having a cover with a wire stuffer bar for forcing the wire (32) into the slot (6). The walls (28) of the constricted slot portion (18) and the anvil (12) make contact with the wire (32) from three sides.

11 Claims, 3 Drawing Sheets

26
28
24
2
72
76
70
76
73
80
78
80
74
30
64
62
66
63
64
42
47
68
2
2
64
66
28
66
60
68
62
68
40
50
40
63
58
47
56
48
50
38
52
44
48
54

HEAVY CURRENT ELECTRICAL TERMINATION MEANS

This invention relates to a heavy current electrical terminal comprising a metal plate having a wire receiving slot, to an electrical connector comprising the terminal and to an electrical connection between such a terminal and an insulated wire.

In order to make such a connection, the wire is forced into the wire receiving slot, transversely of the longitudinal axis of the wire, so that the edges of the slot pierce the insulation of the wire and the wire is firmly gripped between opposed side walls of the slot so that permanent electrical connection is produced between the wire and the terminal.

Such terminals are usually used where the current to be drawn amounts only to a few amperes and indeed, for this purpose, they have proved to be entirely satisfactory. It has been found, however, that where the current to be drawn is heavy, amounting for example to some 25 amperes, these known terminals provide insufficient electrical contact between the slot walls and the wire.

There is disclosed in U.S. Pat. No. 4,018,499 an electrical terminal which comprises a metal plate having formed therein an elongate wire receiving slot having at one end thereof a flared mouth opening into an edge of the plate and having insulation severing edges, an insulation piercing member projecting from the other end of the slot towards said mouth.

According to the present invention, said member is in the form of a wire support anvil having a wire supporting free end, the slot having an elongate constricted portion extending between the mouth and the free end of the anvil and the anvil cooperating with side wall portions of the slot, on each side of the anvil to define a pair of insulation sinks, each communicating with the constricted portion of the slot.

As the wire is forced into the slot, the insulation severing edges of the mouth cut through the insulation of the wire laterally and the wire enters the constricted portion of the slot, the side walls which are thereby forced slightly apart, the insulation severing free end of the anvil then cutting through the insulation of the wire from beneath and the remaining part of the insulation beneath the wire, being forced into the wire sinks on either side of the anvil which also engages the wire, so that the wire is electrically connected to the terminal on three sides. The anvil prevents further insertion of the wire into the slot and the position of the wire in the slot is thereby closely controlled. The wire sinks enhance the ability of the side walls of the constricted portion to move apart from each other, and are therefore, preferably elongate in the direction of the slot.

The constricted portion of the slot preferably has substantially parallel rectilinear side walls which are flat, so as to provide the maximum contact area between the wires and the side walls of said constricted portion.

Since the anvil supports, rather than enters, the wire, the tensile strength of the connection between the terminal and the wire is not impaired.

The free end of the anvil is preferably arcuately relieved, being concave so as better to support the wire.

The mouth, the constricted portion of the slot, and at least a portion of each insulation sink are preferably defined by a pair of arm portions of the plate, which project from the remainder thereof.

The flared mouth of the slot preferably has arcuate side walls which are oppositely bowed, inwardly of the mouth, so as progressively to cut through the insulation of the wire, said arcuate side walls being chamfered to provide the insulation severing edges of the mouth.

The terminal may be mounted in a housing having a cover provided with a wire stuffer bar for forcing the wire into the slot. Where, for example, the current to be drawn, amounts to some 50 amps, a second and identical terminal may be mounted in the housing so that the terminal-wire contact area is thereby doubled, the stuffer bar serving to insert both wires simultaneously into the slots of the terminals. Since the force needed to insert the wire into the slots of the two terminals will be substantial, means may be provided for closing the cover drawn on the housing in stages and for latching the cover to the housing at the end of each stage. Surfaces of the housing may be arranged to assist in the positioning the wire in the slot at the correct depth therein.

The housing may, for example, be provided with a further terminal or further terminals where larger currents are to be drawn.

A conventional insulation displacement terminal may be provided in the housing, a corresponding wire stuffer being provided in the cover, for the connection of a lower current wire, for example, a signal wire. Each terminal may be formed with a mating portion, for example a tab projecting through an opening in the housing for connection to an external electrical circuit.

According to another aspect of the invention, an electrical connection between an electrical terminal and an electrical wire surrounded by an insulating sheath, comprises an electrical terminal in the form of a metal plate having a wire receiving slot with an elongate part between opposed side walls of which the wire is constrained, is characterized in that said elongate part is constricted and the wire is supported on an anvil projecting from an end of the slot to a position adjacent to said constricted part thereof and the insulation of the wire extending into insulation sinks defined by the anvil and further side walls of the slot.

The side walls of the constricted part of the slot, and the anvil, are preferably such that the wire, which will normally be a multistranded wire of circular cross-sectional shape, is plasticly deformed, as a result of its being forced into the slot, to assume a substantially rectangular cross-sectional shape.

For a better understanding of the invention and to show how it may be carried into effect, reference will now be made by way of example to the accompanying drawings, in which.

Figure 2:
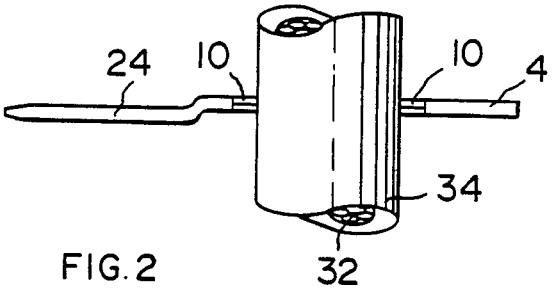
FIG. 2 is a plan view of FIG. 1.
Figure 1:
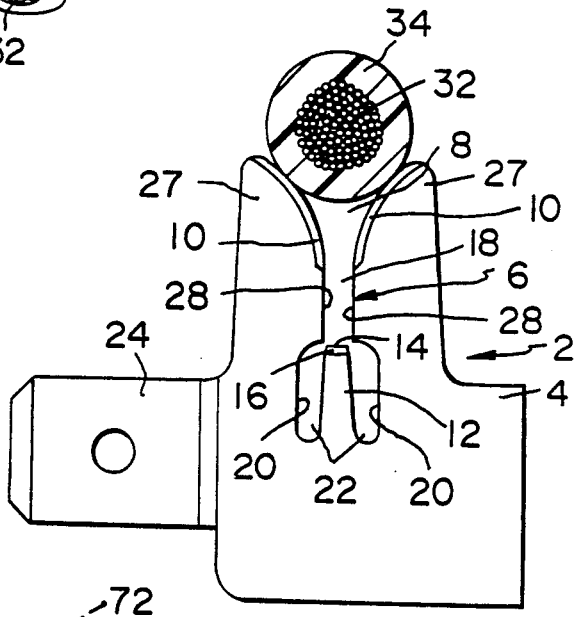
FIG. 1 is an elevational view of a heavy current insulation displacement electrical terminal and a heavy current insulated electrical wire, which is shown in cross-section, about to be inserted into a wire slot of the terminal.

As shown in FIGS. 1 and 2, a heavy current insulation displacement electrical terminal 2 comprises a flat metal plate 4 having formed therein an elongate wire receiving slot, generally referenced 6, having at one end a flared mouth 8 opening into an edge of the plate 4 and having insulation severing edges 10. A wire supporting anvil 12 projects from the other end of the slot towards the mouth 8 and has a wire supporting free end 14 which is chamfered to provide an insulation severing edge 16. The slot 6 has an elongate constriction portion 18 extending between the mouth 8 and the free end 14 of the anvil 12. The anvil 12 cooperates with side wall portions 20 of the slot 6 on each side of the anvil 12, to define a pair of elongate insulation sinks 22, each communicating with the portion 18 of the slot 6 and extending longitudinally thereof. The insulation sinks 22 are of approximately the same length as said portion 18 of the slot 6. A mating portion in the form of a tab 24 for mating with an electrical receptacle 26 (FIG. 7) extends laterally from the plate 4 and is integrally formed therewith.

Figures 4, 7:
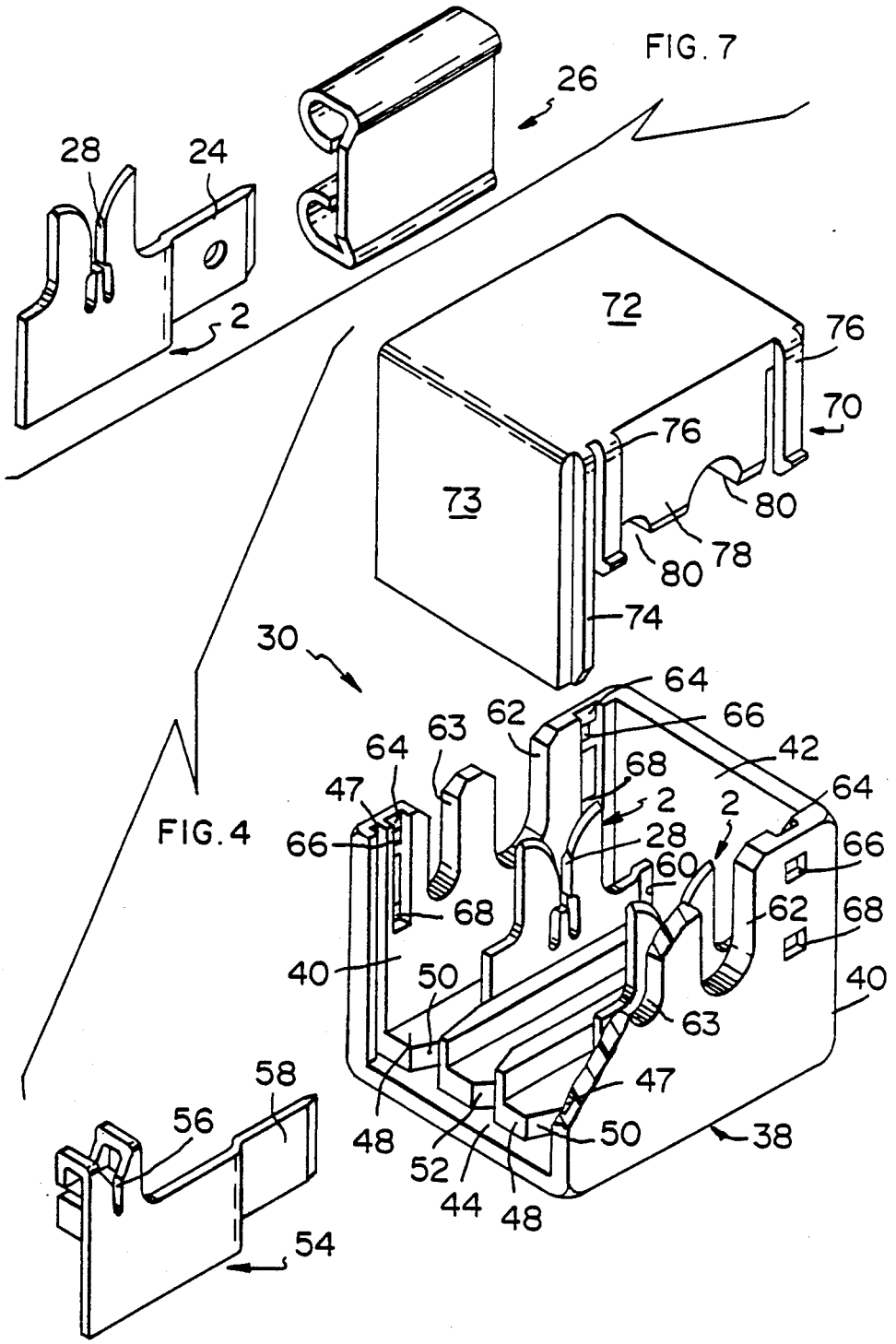
FIG. 4 is an exploded perspective view of an electrical connector for terminating a power supply wire and a signal wire, and comprising said cover.
FIG. 7 is a perspective view of the terminal, in association with an electrical receptacle for mating therewith.

The constricted portion 18 of the slot 6, has opposed, substantially parallel rectilinear side walls 28. As best seen in FIGS. 4 and 7, th side walls 28 are flat, and have not been chamfered to produce a cutting edge as have the walls of the mouth 8 and the edge 16 of the anvil 12. The severing edges 10 of the mouth 12 are arcuate, being oppositely bowed inwardly of the mouth 8. The mouth 8, the constricted portion 18 and part of insulation sinks 22 are defined by arm portions 27 of the plate 4 which project from the remainder thereof.

As best seen in FIG. 4, an electrical connector 30 for terminating a heavy current electrical power supply wire 32, which is multistranded and is surrounded by a heavy elastomeric insulating sheath 34, and an insulated low current signal wire 36, comprises an open topped, insulating housing 38 having end walls 40 connected by a side wall 42, and a base wall 4, the side of the housing 38 opposite to the side wall 42 being open and being bounded laterally, by uprights 46 provided with grooves 47 extending along the full height thereof. There are formed on the internal surface of the base 44, lands 48 defining grooves 50 each for slidably receiving a terminal 2 and a groove 52 for slidably receiving a conventional insulation displacement terminal 54 having a wire slot 56 and a mating portion in the form of a tab 58. Each terminal can be inserted into its groove so that the tab projects through a slot 60 in the wall 42 for connection to an external electrical circuit by means of a receptacle 26 (FIG. 7) mating therewith.

Figure 3:
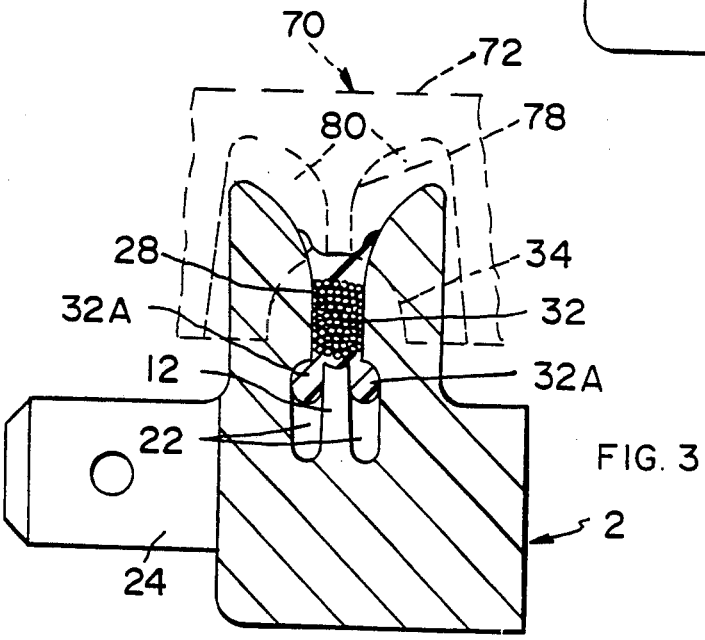
FIG. 3 is a sectional view illustrating the terminal when the wire has been inserted into the slot and showing, in broken lines, part of a cover having a wire stuffer bar which has been used to insert the wire into the slot.
Figure 5:
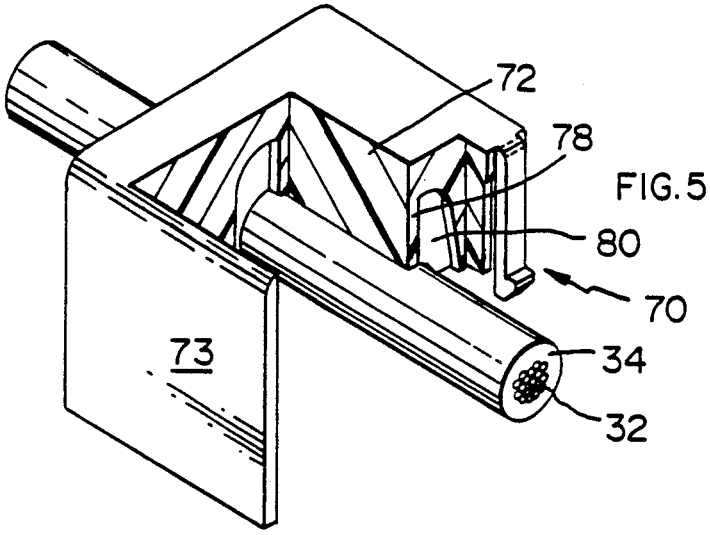
FIG. 5 is a perspective view, shown partly in section, of the cover, in association with the power supply wire.
Figure 6:
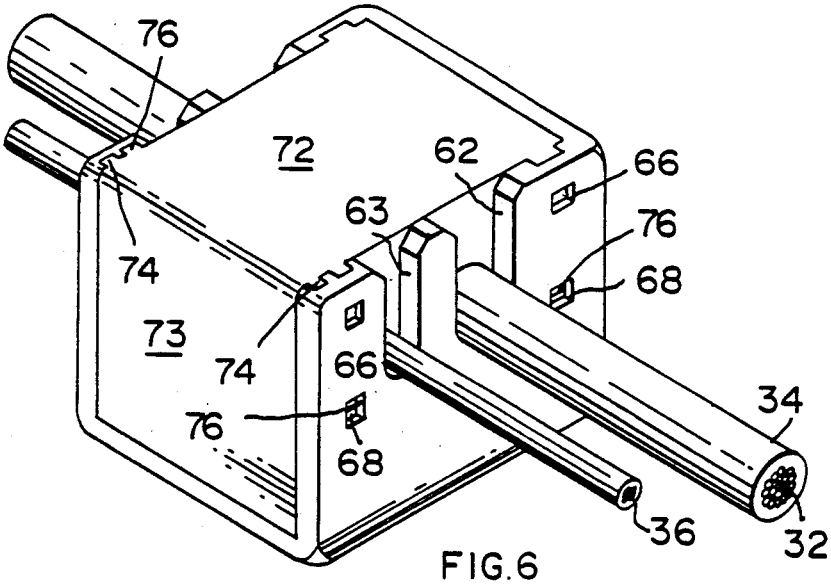
FIG. 6 is a perspective view of the connector with the wires terminated thereto.

Each side wall is formed with notches 62 and 63 for receiving the wires 32 and 36, respectively, with grooves 64, opening into the free edges fo the side walls 40, and spaced openings 66 and 68 communicating with each groove 64, the openings 68 being nearer to the base 44 than the openings 66. As best seen in FIGS. 4 and 5, a cover 70, for the housing 38 comprises a base 72 from one side of which depends a side wall 73 provided with ribs 74 for engaging in the respective grooves 47 of the housing 38. Two spaced latch arms 76 depend from each of the sides of the base 72 which are adjacent to that from which the side wall 73 depends. The base 72 is formed internally thereof with a wire stuffer bar 78 bounded by recesses 80 as best seen in FIG. 3. The stuffer bar 78 is provided for stuffing the wire 32 into the slots 6 of the terminals 2. A further stuffer bar (not shown) is provided for stuffing the wire 36 into the slot 56 of the terminal 54.

In order to terminate them, the wires 32 and 36 are first laid in their respective notches 62 and 63 in the side walls 40 of the housing 38, after which the ribs 74 of the side wall 73 of the cover 70 are inserted into the grooves 47 of the housing 38 until the latch arms 76 engage in the openings 66 in the walls 40 of the housing 38 thereby causing the stuffer bar 78 to force the wire 32 down into the mouth 8, so that the edges 10 thereof sever the insulation 34 of the wire 32 on each side thereof. The ribs 34 are then advanced further into the grooves 47 until the latch arms engage in the openings 68 in the walls 40 whereby the wire 32 is forced into the constricted portion 18 of the slot 6 of the terminal 2 as shown in FIG. 3 to come to rest on the anvil 12, so that the insulation below the wire 32 is severed by the edge 16 of the anvil 12 whereby the wire 32 is directly supported by the free end 14 of the anvil 12 and portions 32a of the insulation 34 are extruded into the insulation sinks 20, the wire 32 being plasticly deformed between the side walls 28 and the anvil free end 14 to a substantially rectangular cross-sectional shape as shown in FIG. 3. The bases of the notches 62 and 63 against which the wires are urged by the stuffer bars, assist in correctly positioning the wires in the slots of the terminals.

The recesses 80 allow the arm 27 to be forced apart by the wire 32 as it is forced into the said portion 18 of the slot 6. Since the spring beam characteristics of the arm portions 27 of each terminal 2, are enhanced by the presence of the insulation sinks 23, considerable oversize of the wire 32 with respect to the width of the constricted portion 18 of the slot 6 is allowed for, so that the contact force exerted by the side walls 28 of the portion 18 against the wire 32 is sufficient to deform it to the rectangular cross-sectional shape shown in FIG. 3. The fact that the side walls 28 are flat and that the anvil 12 directly engages the wire 32, ensures that the area of electrical contact between the terminal 2 and the wire 32 is maximized. Also, the anvil 12, which supports the wire 32, does not enter it so as to impair the tensile strength of the connection between the terminal 2 and the wire 32. The anvil 12 ensures that the wire cannot be inserted beyond the constricted portion 18 of the slot 6 so as to overstress the arms 27. The wire 32 is, therefore, always correctly positioned in the slot 6, following its insertion, and the contact force exerted by the side walls 28 is therefore adequate. The wire 36 is driven into the wire slot 56 of the terminal 54. The engagement of the latches 76 in the openings 68 in the housing side walls 40 ensures that the strands of the wire 32 do not ride up in the slot 6 as to impair the contact force exerted against the wire by the side walls 28.

I claim:

1. An electrical terminal for making electrical connection with a multistranded electrical wire surrounded by an insulating sheath, said terminal comprising a metal plate having formed therein an elongate wire receiving slot having at one end thereof a flared mouth opening into an edge of the plate and having insulating severing edges, an insulation piercing member projecting from the other end of the slot towards said mouth; wherein said member is in the form of a wire support anvil having a free end for directly supporting said wire without penetrating the strands thereof, the slot having an elongate constricted portion extending between the mouth and the wire supporting free end of the anvil, and the anvil cooperating with side wall portions, of the slot on each side of the anvil, to define a pair of insulating sinks for receiving only the insulation of said wire and each communicating with the constricted portion of the slot.

2. A terminal as claimed in claim 1, wherein the constricted portion of the slot has substantially rectilinear, flat side walls.

3. A terminal as claimed in claim 2, wherein the side walls of said constricted portion are substantially parallel to one another.

4. A terminal as claimed in claim 1 wherein the free end of the anvil is arcuately relieved and is chamfered.

5. A terminal as claimed in claim 1, wherein the moutgh has arcuate chamfered side walls which are oppositely bowed towards one another inwardly of the mouth.

6. A terminal as claimed in claim 1, wherein the insulation sinks are in the form of slots which are approximately the same length as the constricted portion of the wire receiving slot, and extend lengthwise thereof.

7. An electrical terminal as claimed in claim 1, wherein the mouth, the constricted portion of the slot, and at least a portion of each insulation sink are defined by a pair of arm portions of the plate, which portions project from the remainder of the plate.

8. An electrical connector comprising a housing, and a cover therefor, wherein an electrical terminal according to claim 1 is secured to a base of the housing with the mouth of the wire receiving slot of the terminal opening in a direction away from the base, the cover being provided with a wire stuffer bar and being latchingly engageable with the housing to cause the stuffer bar to force an insulated wire laid in the mouth of the wire receiving slot of the terminal, into the constricted portion of the slot of the terminal, into the constricted portion of the slot to engage the free end of the anvil, the cover defining recesses on each side of the stuffer bar to allow the terminal to be expanded by the wire as it is forced into said constricted portion.

9. An electrical connection between an electrical terminal and a multistranded electrical wire surrounded by an insulating sheath, said connection comprising a terminal in the form of a metal plate having a wire receiving slot with an elongate part between opposed side walls of which the wire is constrained; wherein said elongate part is constricted and the wire is supported on a free end of an anvil engaging the exterior thereof, said anvil projecting from an end of the slot to a position adjacent to said constricted part thereof and the insulation of the wire extending into insulation sinks defined by the anvil and further side walls of the slot, the strands of said wire lying outside said insulation sinks.

10. A connection as claimed in claim 9, wherein the wire has been plastically deformed between the side walls of the constricted part of the slot, the anvil, and a wire stuffer member, to substantially rectangular cross-sectional shape.

11. An electrical terminal for making an electrical connection with a multistranded electrical wire surrounded by an insulating sheath, said terminal comprising a metal plate having formed therein an elongate wire receiving slot having at one end thereof a flared mouth opening into an edge of the plate and having insulation severing edges, an insulation piercing member projecting from the other end of the slot towards said mouth wherein said member is in the form of a wire support anvil having a wire supporting free end for directly supporting the wire without entering between the strands thereof, the slot having an elongate constricted portion extending between the mouth and the free end of the anvil, and the anvil cooperating with side wall portions, of the slot on each side of the anvil, to define a pair of insulation sinks for receiving only the insulation of said wire and each communicating with the constricted portion of the slot, the constricted portion of the slot having substantially rectilinear and parallel flat side walls, the mouth having arcuate chamfered side walls which are oppositely bowed towards one another inwardly of the mouth, the insulation sinks being in the form of slots which are of approximately the same length as the constricted portion of the wire receiving slot, and extend lengthwise thereof.

* * * * *